United States Patent [19]

Bardsley et al.

[11] 4,359,072

[45] Nov. 16, 1982

[54] PRODUCT SHAPING MECHANISM FOR HORIZONTAL POUCH-MAKING MACHINES

[75] Inventors: Robert F. Bardsley, Harrington Park, N.J.; William M. Marks, Irvington, N.Y.

[73] Assignee: General Foods Corporation, White Plains, N.Y.

[21] Appl. No.: 118,246

[22] Filed: Feb. 4, 1980

[51] Int. Cl.[3] ..... B65B 1/24

[52] U.S. Cl. ..... 141/71; 141/181; 141/249; 53/389; 425/253; 425/335

[58] Field of Search ..... 141/249, 69–81, 141/1, 11, 12, 129–192; 53/51, 389, 122, 436, 528, 553, 559, 562; 425/253, 335

[56] References Cited

U.S. PATENT DOCUMENTS

| | | | |
|---|---|---|---|
| 3,103,254 | 9/1963 | Stedman | 425/253 |
| 3,351,977 | 11/1967 | Gasch et al. | 425/335 |
| 3,751,205 | 8/1973 | Patten | 425/253 |
| 4,048,782 | 9/1977 | Hamilton | 53/559 |
| 4,105,383 | 8/1978 | Hanson | 425/253 |

*Primary Examiner*—Houston S. Bell, Jr.

*Attorney, Agent, or Firm*—C. Garmen Hubbard; Thomas V. Sullivan; Daniel J. Donovan

[57] ABSTRACT

Associated with a horizontal pouch making machine for packaging a free flowing granular product between webs of flexible packaging material is a product lay down mechanism operable for receiving measured amounts of the product and depositing it in precisely defined areas of one of the webs being processed and in a flattened configuration such as to minimize the amount of packaging material required to contain said product. A product shaping member contacting the web surface during a dwell in the web feed cycle is formed with apertures which in combination with the web define cavities or molds which shape each deposit of product delivered thereto into the desired configuration having uniform height over substantially the entire surface area of the web portion upon which it is laid.

10 Claims, 6 Drawing Figures

FIG. 6.
FIG. 1.
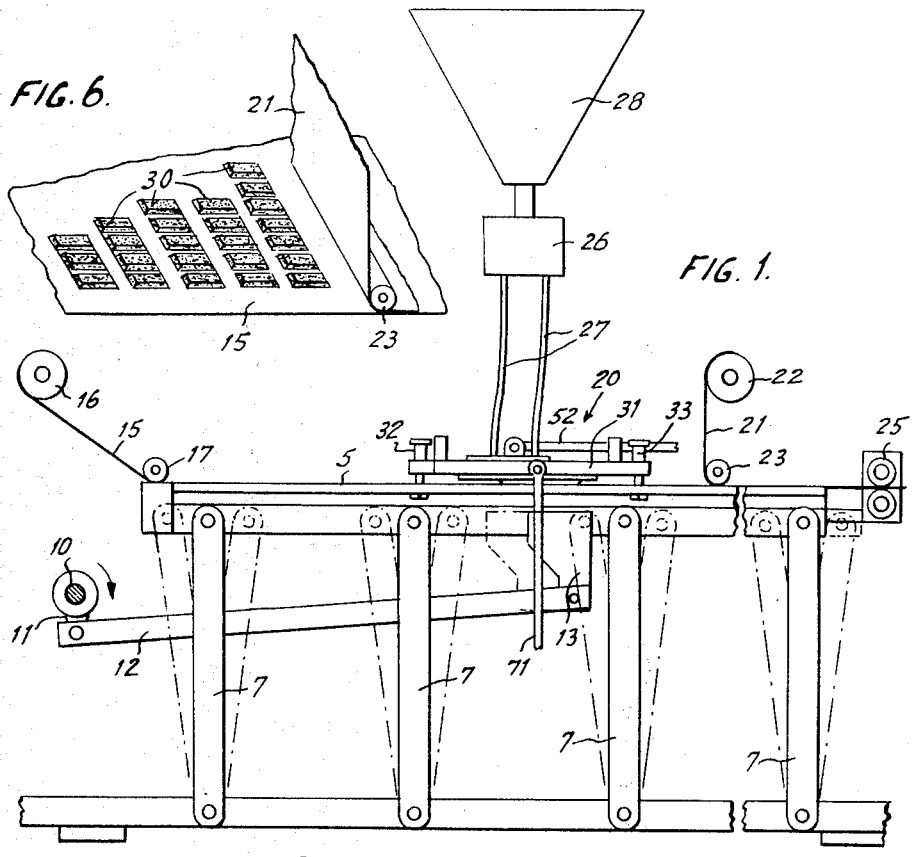
FIG. 2.
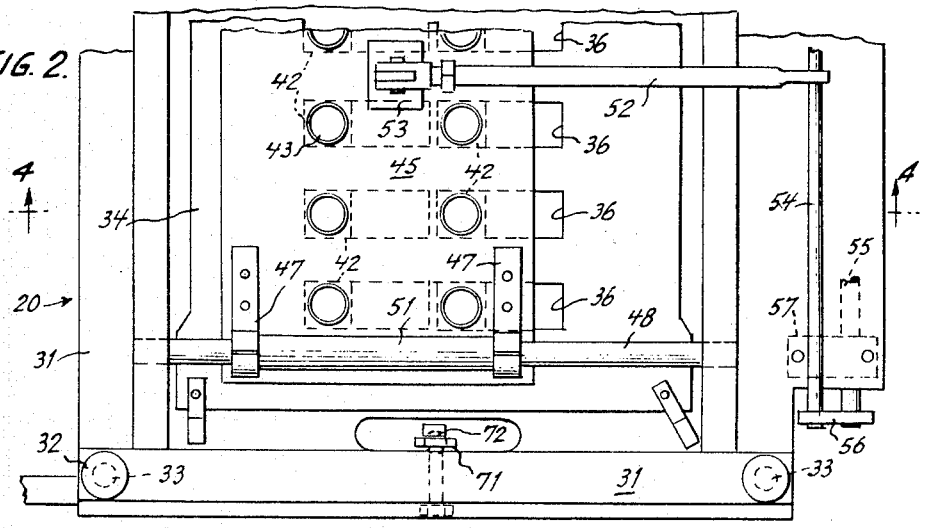

PRODUCT SHAPING MECHANISM FOR HORIZONTAL POUCH-MAKING MACHINES

BACKGROUND OF THE INVENTION

This invention relates generally to packaging machinery operable on horizontally fed web material to form, fill and seal individual pouches, each containing a free-flowing granular or powdery product. More particularly, the invention relates to means associated with the filler mechanism whereby the product is deposited or laid down on the web material at precisely defined areas thereof and in a predetermined configuration so as to minimize the amount of web material required for packaging a given amount of product.

In packaging machines of this type a first or bottom web is customarily fed in a horizontal plane beneath a filler mechanism where a predetermined amount of the product is dropped on the web during a dwell in the feed cycle. As the web continues to feed past the filler mechanism a second or top web is introduced into the feed path in overlying relation to the bottom web and the product thereon. Thereafter, as the two webs continue to feed they are sealed together in the areas surrounding the product, thereby forming individual pouches containing the granular product.

When the web material is of a width to accommodate the formation of several pouches simultaneously in several respective lanes, the web material will be sealed together between adjacent pouches in both a longitudinal direction and a transverse direction so as to result in pouches having a rectangular configuration.

In conventional apparatus of this type, when a granular free-flowing product material is dropped or deposited on the product receiving area of the lower web the deposit tends to take on the configuration of a mound or pile of non-uniform height; the maximum height of the mound being located only at its central portion overlying only a relatively small or minor portion of the product receiving area of the bottom web. Thus, in order to effectively enclose a product by the top web when said product has such a mounded configuration, the amount of web material employed must be sufficient to allow for bulging thereof to an extent required for the maximum height of the mound being contained. This amount is considerably more than would be required if product material of the same volume had a configuration which was flatter or more nearly uniform in height over the major portion of the product receiving area of the web material. Furthermore, when granular material is loosely deposited on the web in the form of a mound the precise surface area of the web covered by the mound cannot be accurately predicted due to the random manner in which the free flowing material builds up into a mounded configuration. Thus, in order to provide assurance that none of the material will reach the seal area of the web, the product receiving area of the web needs to be larger than otherwise would be the case.

SUMMARY OF THE INVENTION

In accordance with the invention, means are provided for not only shaping the free-flowing granular product into a preferred configuration, but also for precisely locating the shaped deposit on the web surface such that maximum utilization is made of the amount of web material allotted to each pouch. The mechanism by which this is accomplished is contained in an assembly which is mounted for a slight amount of vertical movement above the horizontally fed lower web. The assembly includes a plate formed with apertures each of which, when the plate is lowered into contact with the web during the dwell portion of the web feed cycle, serves as a cavity or mold for shaping each deposit of product to be contained in a pouch. Slidably mounted on the upper surface of said cavity plate is a fill-block formed with a product chamber associated with each cavity, each said fill-block product chamber being in communication with the filler mechanism for receiving therefrom measured amounts of product to be contained within the respective pouch. Said fill-block receives the product from the filler when the block is in a sealed off position with each chamber out of communication with its respective mold cavity. When the cavity plate is lowered into contact with the web, the fill-block is actuated and slid to its discharge position to place each chamber thereof in communication with its respective cavity and in so doing acts to spread the granular product evenly and uniformly over the entire area of the cavity. In this manner the deposit of material is given a flat top surface with the entire deposit being substantially the same depth over the entire product receiving area of the web. The use of a cavity plate for defining and determining the configuration of the product also has the effect of minimizing the possibility of some of the granular product flowing into the sealing areas of the web material.

It is, therefore, an object of this invention to make more efficient utilization of packaging material when packaging a granular free-flowing product on a horizontal pouch making machine.

It is a further object of the invention to enable the shaping of a granular free-flowing material into a preferred configuration in the course of packaging same on a horizontal pouch making machine.

It is still a further object of the invention to prevent granular free-flowing product material, when deposited on a web feeding through a horizontal pouch making machine, from spreading into the sealing areas of the web material.

Further objects of the invention together with the features contributing thereto and the advantages accruing therefrom will be apparent from the following description when read in conjunction with the drawing.

DESCRIPTION OF THE FIGURES

FIG. 1 is a side elevational view of a horizontal pouch forming machine illustrating the product lay down assembly of the instant invention in relation thereto.

FIG. 2 is a partial plan view in larger scale of the product lay down assembly shown in FIG. 1.

FIG. 6 is a perspective view of a portion of the web material after leaving the lay down assembly with shaped deposits of granular material placed thereon.

DETAILED DESCRIPTION

Figure 3:
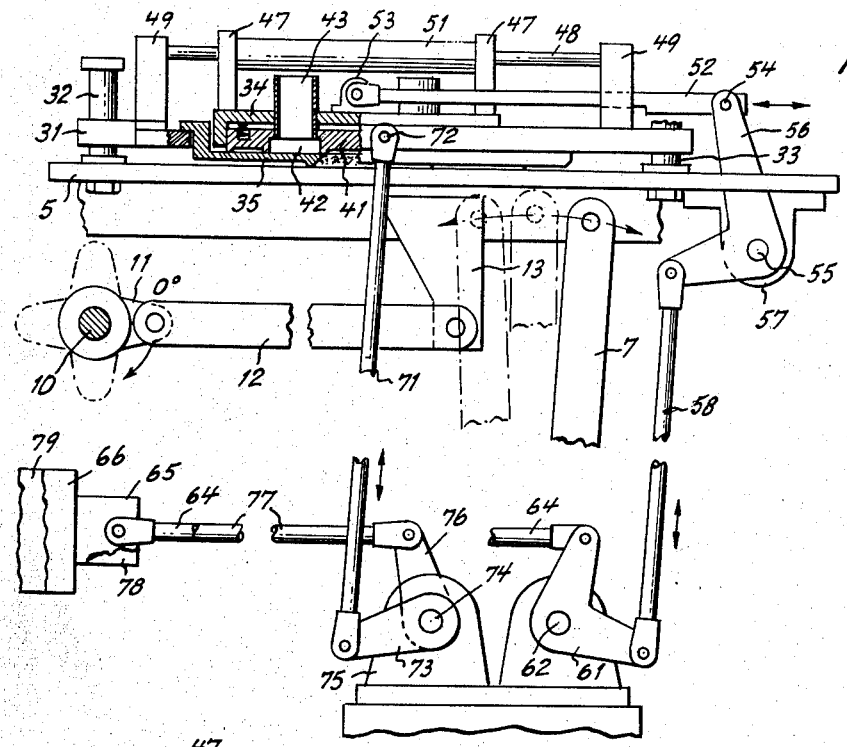
FIG. 3 is a view in side elevation of the product lay down assembly, including its driving linkage, in one operative position thereof.

With reference now in particular to FIG. 1, there is shown parts of a pouch making machine of the horizontal type which employs a web feed concept of the type shown and described in U.S. Pat. No. 4,048,782 entitled "Controlled Film Advance Apparatus" and issued to Joel A. Hamilton on Sept. 20, 1977. As therein described the mechanism includes a movable frame comprised of a horizontally disposed bed plate (5) connected to support bars (6). The support bars (6) of which there is one on each side of the machine, one shown, are each pivotally joined to the upper ends of a series of vertical links (7) which links at their lower extremities are pivotally connected to bars (8), one shown, which comprise a part of the main frame of the machine. Thus the movable frame including bed plate (5) is mounted for oscillatory movement, back and forth, in a generally horizontal plane with the movable framework being oscillated by a continuously rotating main drive shaft (10) suitably journaled in the main frame of the machine and carrying a crank arm (11) pivotally attached to one end of a pitman (12). The other end of the pitman is pivotally attached to a depending bracket (13) secured to a part of the movable frame so that, as can be seen, for each revolution of the shaft (10) the movable frame and all parts attached thereto or mounted thereon will undergo one complete oscillation which, for purposes of this description, will be considered one web feed cycle.

A first or bottom web (15) supplied from a spool (16) suitably mounted by any conventional means near one end of the machine is guided around a roll (17) and drawn across the upper surface of the bed plate (5) and beneath the product lay down assembly (20) to be hereinafter more fully described. After leaving the lay down assembly the lower web (15) carrying deposits of the product is overlaid with a second or top web (21) which is drawn from a spool (22) suitably supported above the apparatus and drawn around a guide roll (23). Both webs then proceed through a web sealing station, not shown, whereat the two webs are sealed together along their sealing areas to subdivide the webs into individual sealed pouches for each deposit of product. The webs then proceed eventually to feed rolls (25) mounted on the movable framework and from whence the individual sealed pouches may be separated from the web for further handling and processing. The feed rolls (25), while continually gripping the two webs to effect their continuous withdrawal from their respective supply spools, are controlled so as to be inactive (non-rotative) during the forward stroke (left to right as seen in FIG. 1) of the oscillating frame. During this half cycle of oscillating movement the web is being advanced solely by the movement of the frame itself and not by any rotative movement of the feed rolls (25). The extent of web movement during this forward motion of the movable framework is the length of one pouch. During the return motion (right to left) of the framework in the next half-cycle of web feed, the feed rollers while being carried rearwardly with the movable frame are, however, activated so as to continue the forward advance of the webs relative to the main fixed frame of the machine a distance corresponding to the length of one pouch. Thus, it will be seen that during the course of two web feed half-cycles the webs are advanced a distance equal to the length of two pouches. During the half cycle first described the webs advance the length of one pouch relative to the main machine frame since the feed rolls are, in that half cycle, inactive and there is no movement of the webs relative to the movable oscillating framework. Throughout the next half cycle the activated feed rolls (25) continue advancing the webs relative to the main framework the length of one pouch during which time the webs are advanced relative to the then rearwardly moving framework and all mechanisms mounted thereon a distance equivalent to the length of two pouches. Since the feed rolls (25) are inactive in the half cycle first described, so that there is no motion of the web relative to the movable frame, even though the web is advancing relative to the main fixed frame, said first described half cycle will be hereinafter referred to as the dwell portion of the web feeding cycle.

The product to be packaged, which may be a free-flowing granular material (30), is delivered to the lay down assembly (20) from a filler mechanism (26) to which it is connected by a plurality of flexible tubes or hoses (27), the filler in turn being supplied from a hopper (28). The filler may be of any conventional type capable of releasing measured amounts of product upon signal each web feeding cycle. Since in the present instance the type of web feeding mechanism disclosed operates to feed the web two pouch lengths each web feeding cycle, the filler is designed to release for each lane of the web material two separate charges of the product simultaneously for deposit on two successive product receiving areas in each lane of the web material.

The lay down assembly (20) which receives the product from the filler each web feeding cycle can be seen in greater detail in FIGS. 2–5. This assembly comprises an open rectangular frame (31) overlying the bedplate (5) and provided near each corner thereof with a bearing block (32) slidably fitted on a upright guide rod or post (33) secured to the bedplate (5) thus allowing the frame and the entire assembly a limited amount of vertical movement towards and away from the bedplate (5). Suspended from the frame member (31) by means of angled support bars (34) is a horizontally disposed cavity plate (35) having formed therein apertures (36). The apertures are generally rectangular in horizontal cross-section with inwardly tapering side walls so as to have slightly greater dimensions at the bottom surface of the plate than at the top surface. The bottom surface of the cavity plate (35) is flat except in the areas bordering the apertures (36) which are somewhat raised in order to provide a better contact surface when the plate is lowered into engagement with the web (15) as will be hereinafter more fully described.

The upper surface of the cavity plate (35) is smooth and flat and supports for shifting movement relative there to a slidable fill block (41) formed with product fill chambers (42) therein, there being one fill chamber associated with each of the apertures in the cavity plate (35). The chambers (42) are also generally rectangular in horizontal cross-section and have a lateral dimension substantially equal to that of the associated apertures (36). The top surface of the fill block (41) is also formed with an opening communicating with each fill chamber (42) and fitted with a coupling tube (43) to which is attached one of the flexible tubes (27) extending from the filler as herein before described, thus placing the fill chambers in communication with the filler mechanism for receiving product to be packaged each web feeding cycle of the apparatus.

The fill block (41) is housed within a coverplate (45) the side edges of which extend downwardly to encompass the sides of the fill block in a snug slide fitting relationship to permit a slight amount of vertical movement of the fill block within the housing provided by the coverplate. Compression springs (46) seated in the top of the fill block and bearing against the top of the coverplate (45) bias the fill block in a downwardly direction. It will be seen that the bottom surface of the fill block is slightly raised along its border and in the area bordering the fill chambers (42) so as to minimize the amount of bearing surfaces between the fill block and the cavity plate while providing a firm bearing contact around the edges of each fill chamber.

Figure 4:
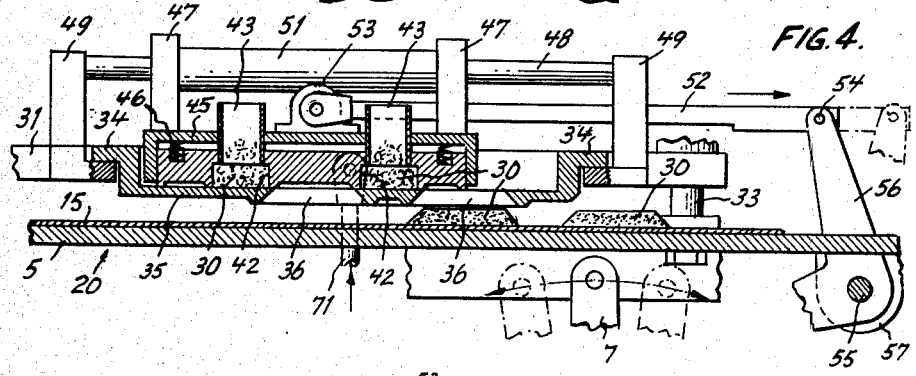
FIG. 4 is a sectional view of the product lay down assembly in another operational view thereof taken along the line 4—4 of FIG. 2.
Figure 5:
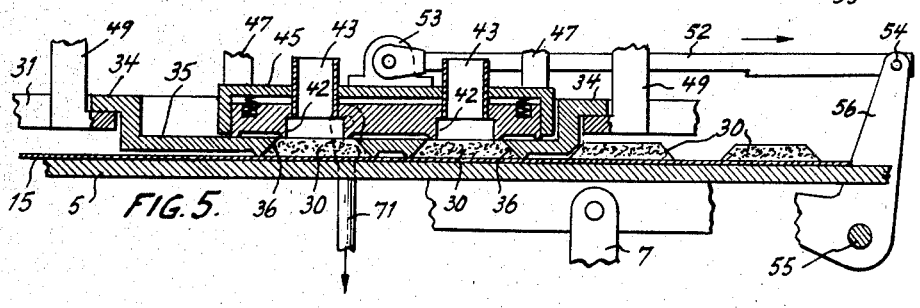
FIG. 5 is a view along the same section as FIG. 4 but showing the parts in still another operational position thereof.

In order to enable the fill block (41) to slide horizontally over the surface of the cavity plate (35) from the position shown in FIG. 4 to that shown in FIG. 5 the cover plate (45) is provided with a pair of bearing blocks (47) carrying bearings slide fitted to a shaft (48) supported at each end thereof in brackets (49) secured to the frame (31) of the overall assembly. If desired a shroud (51) for shaft (48) may be provided between the blocks (47) to help maintain that portion of the shaft free of dirt or other foreign matter. In the position of the fill block shown in FIGS. 3 and 4 it should be noted that the product chambers (42) therein overly the surface of the cavity plate (35), out of register with the respective apertures (36), so that any product received in a product chamber is retained therein as long as the chamber remains in its sealed off relation to its respective aperture. FIG. 5 illustrates the position of the fill block when shifted or slid to its product discharge position wherein the product chambers are moved into overlying relation to and in registration with the respective apertures in the cavity plate. The product is thus discharged into an aperture which in combination with the underlying web defines a mold or cavity for shaping the product into the configuration of the cavity. The fill block when sliding to and from its product discharge position spreads the granular product over the entire area of the respective cavity so as to leave the molded deposit of granular material with a flat top surface. It will, of course, be understood that the volume of each cavity is matched to the volume of product to be deposited in each filling operation so that each cavity will be completely filled without voids and with a top surface substantially level with the top surface of the cavity plate after the fill block returns to its original sealed off position.

Sliding movement is imparted to the fill block (41) through means which includes a link (52) pivotly connected at one end to a bracket (53) secured to the fill block cover plate (45). The other end thereof is pivotally joined to a shaft (54) extending across the machine and supported at each end in one arm of a bellcrank (56) carried by a rock shaft (55) formated in bearing blocks (57) suitably secured to the underside of the bedplate (5). As shown in FIG. 3, the other arm of bell crank (56) is joined to a vertical connecting rod (58) which is attached at its lower end to one arm of a bell crank (61) carried by a shaft (62) suitably journaled in a pillow block (63) secured to the main frame of the machine. The other arm of the bell crank (61) is joined by a connecting rod (64) to the output element (65) of a positive action cam unit (66) which is driven from main shaft 10 and operates at appropriate times at the web feed cycle through the linkage just described to slide the fill block between its respective sealed off and discharge positions.

Means are also provided for raising and lowering the entire lay down assembly at appropriate times in the web feeding cycle so as to bring the cavity plate (35) down into contact with the web (5) to receive a shaped deposit of product thereon during the dwell portion of the web feeding cycle and thereafter to raise the entire assembly, so as to lift the cavity plate above and clear of the product just deposited on the web during the remaining portion of the web feeding cycle wherein the web is advanced and fed relative to the cavity plate and entire lay down assembly by activation of the feed rolls (25) as heretofore explained. The means for lifting and lowering the lay down assembly includes a connecting rod (71) pivotly joined at its upper end to a bearing stud (72) secured to the frame (31) of the lay down assembly, it being understood that there is one such rod and stud on each side of the assembly. The lower end of each rod (71) is connected to a rock arm (73) carried by a rock shaft (74) mounted in pillow blocks (75) secured to the main frame of the machine. Shaft (74) also carries an upright rock arm (76) which is joined by a connecting rod (77) to the output element (78) of a positive action cam unit (79) which operates during appropriate times in the web feeding cycle to raise and lower the lay down assembly shown in FIG. 3 in its lowered position with the cavity plate (35) in contact with the web (15) disposed over the top surface of the bedplate (5).

The timing of the operation of the cam unit (79) is such as to maintain the cavity plate (35) lowered in engagement with the web (15) during substantially the entire half cycle dwell portion of the web feeding cycle. During this portion of the cycle the cam unit (66) is effective for actuating the associated linkage to slide the fill block (41) and the product chambers (42) therein from their sealed off position to their product discharge position and then back again to the sealed off position before the end of the dwell portion of the web feeding cycle. During the next half cycle or non-dwell portion of a web feeding cycle the cam unit (79) is effective through the related linkage for lifting the lay down assembly a sufficient distance and in sufficient time so that the cavity plate (35) is clear of the now moving shaped deposits of product (30) placed on the web in the preceeding half cycle of web feed. During this non-dwell portion of the feeding cycle the fill block (41) is maintained in its sealed off position and the filler mechanism (26) is activated so as to deliver a measured amount of product to each of the fill chambers of the fill block for deposit on the next succeeding product receiving areas of the web during the next dwell portion of the web feeding cycle.

With reference now to the different operational views of the mechanism shown in FIGS. 3–5. FIG. 3 illustrates the various parts and the positions they assume at the start of a web feeding cycle of which the first half is the non-dwell portion and the second half is the dwell portion. It will be noted that the movable framework including the bedplate (5) and the entire lay down assembly (20) mounted thereon have been advanced, from left to right, to the limit of its oscillatory movement by the crank arm (11) carried by driveshaft (10). The extent of the advance movement of the entire assembly is equal to the longitudinal length of one pouch to be fabricated by the mechanism. At this point of the web feed cycle the lay down assembly lift mechanism has just started to operate to raise the cavity plate (35) off the web (15). The fill block (41) is in its sealed off position with the product chambers (42) devoid of any product, the product having been deposited on the web and in the product shaping cavities by actuation of the fill block during the dwell portion of the previous web feed cycle. As the machine continues into the first half of the cycle the entire lay down assembly is lifted quickly to raise the cavity plate (35) to a position clear of the product deposited on the web in the preceeding web feed cycle. The entire lay down assembly moves rearwardly from right to left while the web continues to advance from left to right by feed rolls (25) which during this position of the cycle are activated. Also during this portion of the cycle the filler mechanism (26) is activated to dispense measured amounts of the product to each of the product chambers (42) in the fill block (41).

FIG. 4 illustrates the position of the assembly parts at a point approximately midway through the non-dwell portion on first half of the web feeding cycle. At this mid-way point of the non-dwell half cycle the fill block is maintained in its sealed off position and the product chambers (42) therein have received another charge of the granular product (30) from the filler. The web (15) has advanced a distance of approximately one pouch length relative to the rearwardly moving lay down assembly.

As the machine approaches the mid-point of a complete web feeding cycle and the lay down assembly (20) approaches the limit of its return movement, the assembly starts to lower again so that the cavity plate (35) will contact the web shortly after the start of the dwell portion of the cycle and after the feed rolls (25) have been deactivated. At this mid point of the web feeding cycle the web will have been advanced relative to the lay down assembly a distance equivalent to the length of two pouches so that when the lay down assembly again contacts the web the apertures (36) in the cavity plate (35) will be in register with the next succeeding two product receiving areas in each lane of the web. As the machine continues through the dwell portion of the web feeding cycle, wherein the web advances with the lay down assembly, the fill block (41) is activated and shifted from its sealed off position to and then from its product discharge position, the position shown in FIG. 5, to thereby deposit a measured amount of product into each cavity defined in part by the cavity plate. In so doing the product is spread over the entire area of the cavity so that each deposit of the granular material is confined to a pre-determined surface area of the web and in a form or configuration essentially flat and of uniform depth so as to enable efficient packaging thereof with a minimum amount of packaging material. The fill block returns to its sealed off position before the end of the dwell portion of the web feeding cycle (see FIG. 3) in which position it remains to receive another charge of product during the first half of the next web feeding cycle and until activated to discharge such product during the dwell portion of the next web feeding cycle.

FIG. 6 illustrates a section of the lower web (15) after it leaves the lay down assembly showing the arrangement of the individual deposits of granular material (30) thereon before they are covered by the upper web (21) preparatory to being sealed within a pouch structure. It will be seen that the several deposits are arranged in precisely aligned longitudinal lanes and laterally extending rows thereby creating precisely defined sealing areas of the web material running between the several lanes and the several rows. Each deposit is in the general shape of a flattened pile having a generally rectangular base of slightly greater dimensions than its rectangular top thereby creating inwardly tapering sides. This helps to maintain shape integrity for the feeding material by minimizing the breaking away or crumbling of the side walls which would result in spread of the product into the sealing areas to prevent attainment of a good seal between the upper and lower webs. The shape of each deposit is one which makes maximum utilization of the interior area of the resultant pouch thereby minimizing the amount of web material required to package a given amount of product. At the same time it produces pouches which are of flatter configuration due to the more uniform distribution of product over the interior area thereof. The resultant pouches can thus be more efficiently stacked or loaded into cartons, for shipping, storage or the like, of smaller dimensions and with less voids therein than would be the case if the pouches did not have the product as uniformly distributed throughout its interior area.

While there has been shown or described what is considered to be a preferred embodiment of the invention it should of course be understood that obvious modifications can be made without departing from the spirit of the invention. For example, the invention is shown as applied to a packaging apparatus wherein the lay down assembly advances with the web for a portion of the web feeding cycle and in what has been referred to herein as a dwell in the web feeding cycle. Obviously, the lay down mechanism and concepts herein disclosed can be adapted to other feeding systems employing intermittent web feed wherein the lay down assembly does not advance with the web and the dwell portion of the feeding cycle is the time between successive advancing steps wherein the web is at rest. Other obvious modifications or adaptations will be apparent, and it is therefore intended that the invention be not limited to the exact form and details as herein shown and described nor to anything less than the whole of the invention as hereinafter claimed.

What we claim is:

1. In a packaging machine of the class described having means for transporting a web of flexible packaging material in a horizontal plane through a succession of web feeding cycles, and filler means disposed above said web for discharging measured amounts of a granular free flowing product for deposit on a said web each web feeding cycle, lay down means for forming each deposit of said product into a predetermined shape and depositing it in a pre-determined area of said web each web feeding cycle, said lay down means comprising:

(a) a product forming member disposed above said web and having apertures therethrough of a configuration corresponding to that of said pre-determined shape, said member being vertically movable into and away from engagement with said web defining therewith at each aperture therein an open flat-top cavity for shaping and positioning the free flowing product delivered thereto, said cavity being defined by the upwardly extending side walls of said aperture within said product forming member and the top surface of said web when said product forming member is vertically moved into engagement with said web so as to define the bottom of said cavity, and (b) a product deposit member supported on said forming member in slidable relation thereto between a product receiving position and a product discharging position, said deposit member being formed with an opening therethrough associated with each aperture of said forming member, each said opening being in communication with said filler and adapted to receive a measured amount of product therefrom when in its product receiving position and sealed off from its associated aperture, said deposit member when moved into its product discharging position placing each opening therein into communication with the associated aperture in said forming member, so as to completely fill said cavity with product from said deposit member evenly and uniformly and imparting a flat topped configuration to said product, whereby said product is deposited on said web and spread into a flat top configuration corresponding to that of said cavity when said product forming member is raised away from the web.

2. The invention according to claim 1, wherein said product forming member is a plate disposed in parallel relation to the surface of said web and wherein the apertures formed therein are essentially rectangular in configuration.

3. The invention according to claim 2, wherein the dimensions of the rectangular apertures in said forming plate are smaller at the top surface of said plate than at the bottom surface of said plate, whereby the side surfaces of said apertures taper inwardly in an upward direction.

4. The invention according to claim 1, wherein each web feeding cycle includes a dwell portion in which said web does not advance relative to said lay down means, and including actuating means for moving said forming plate into engagement with said web during said dwell portion of the web feeding cycle.

5. The invention according to claim 4, including actuating means for moving said deposit member to and from its product discharge position while said forming plate is in engagement with said web during the dwell portion of the web feeding cycle.

6. The invention according to claim 5, wherein said product deposit member is yieldingly biased into engagement with the upper surface of said product forming member.

7. The invention according to claim 1, in a machine wherein said web transporting means includes an oscillating frame movable back and forth in the direction of web feed once each web feeding cycle and having web feed rolls mounted thereon, said web being advanced one pouch length by the forward movement of said frame during a dwell portion of the web feed cycle, said web being advanced one pouch length by activation of said web feeding rollers upon the return movement of said frame during a non-dwell portion of a web feeding cycle, and wherein said lay down means is mounted on said frame to oscillate therewith and is operative during the dwell portion of each web feeding cycle for placing two shaped deposits of said product simultaneously in two successively spaced product receiving areas of said web.

8. The invention according to claim 7, wherein the product forming member of said lay down means is a plate disposed above said web, the apertures therein being arranged to overly two successive product receiving areas in each lane of said web during the dwell portion of each web feeding cycle.

9. The invention according to claim 7, wherein said product forming member is a plate horizontally disposed above said web and in parallel relation thereto, the apertures therein being of a rectangular configuration.

10. The invention according to claim 9, wherein each dimension of said rectangular configuration at the upper surface of said plate is less than the corresponding dimension of such configuration at the bottom surface of said plate, thereby providing the cavity formed by said aperture when in contact with said web with sides having an inward taper in the upward direction.

* * * * *